United States Patent [19]

Lirette

[11] 4,005,886

[45] Feb. 1, 1977

[54] FLUSH BOLT MECHANISMS

[75] Inventor: Douglas E. Lirette, Ann Arbor, Mich.

[73] Assignee: Door Controls Incorporated, Ann Arbor, Mich.

[22] Filed: Dec. 18, 1975

[21] Appl. No.: 642,183

[52] U.S. Cl. ..... 292/177; 292/21; 292/34; 292/35; 292/92; 292/DIG. 21; 292/DIG. 44; 292/DIG. 66

[51] Int. Cl.[2] ..... E05C 7/06

[58] Field of Search ..... 292/177, 182, 139, 143, 292/DIG. 21, DIG. 44, DIG. 60, DIG. 66, 34, 180, 137, 35, 164, 166, 92, 21

[56] References Cited

UNITED STATES PATENTS

| | | | |
|---|---|---|---|
| 412,986 | 10/1889 | Schoen et al. | 292/180 |
| 1,559,160 | 10/1925 | Carter | 292/DIG. 44 |
| 1,983,125 | 12/1934 | Ellison | 292/139 |
| 2,202,916 | 6/1940 | Mussa | 292/177 |
| 2,281,317 | 4/1942 | McFarlane | 292/164 |
| 2,910,857 | 11/1959 | Muessel | 292/92 X |
| 3,578,369 | 5/1971 | Coopersmith | 292/182 X |
| 3,582,122 | 6/1971 | Foster et al. | 292/DIG. 21 |
| 3,705,739 | 12/1972 | Adler | 292/DIG. 66 |
| 3,811,717 | 5/1974 | Floyd et al. | 292/DIG. 66 |

FOREIGN PATENTS OR APPLICATIONS

| | | | |
|---|---|---|---|
| 602,708 | 6/1948 | United Kingdom | 292/182 |
| 927,383 | 5/1963 | United Kingdom | 292/143 |

*Primary Examiner*—Ramon S. Britts
*Assistant Examiner*—Rodney H. Bonck
*Attorney, Agent, or Firm*—Olsen and Stephenson

[57] ABSTRACT

A flush bolt mechanism is disclosed for latching the inactive one of a pair of swinging doors, the mechanism functioning to latch the closed inactive door in response to closing of the other door. The latch mechanism includes a bolt that is driven home by cam and spring assemblies. A heat-responsive mechanism is provided for retaining the bolt in its extended position when the heat-responsive mechanism is subjected to a temperature and for a time sufficient to melt one of its components. A release mechanism may be provided for retracting the extended bolt in response to a force of preselected magnitude applied against the inside of the inactive door.

9 Claims, 10 Drawing Figures

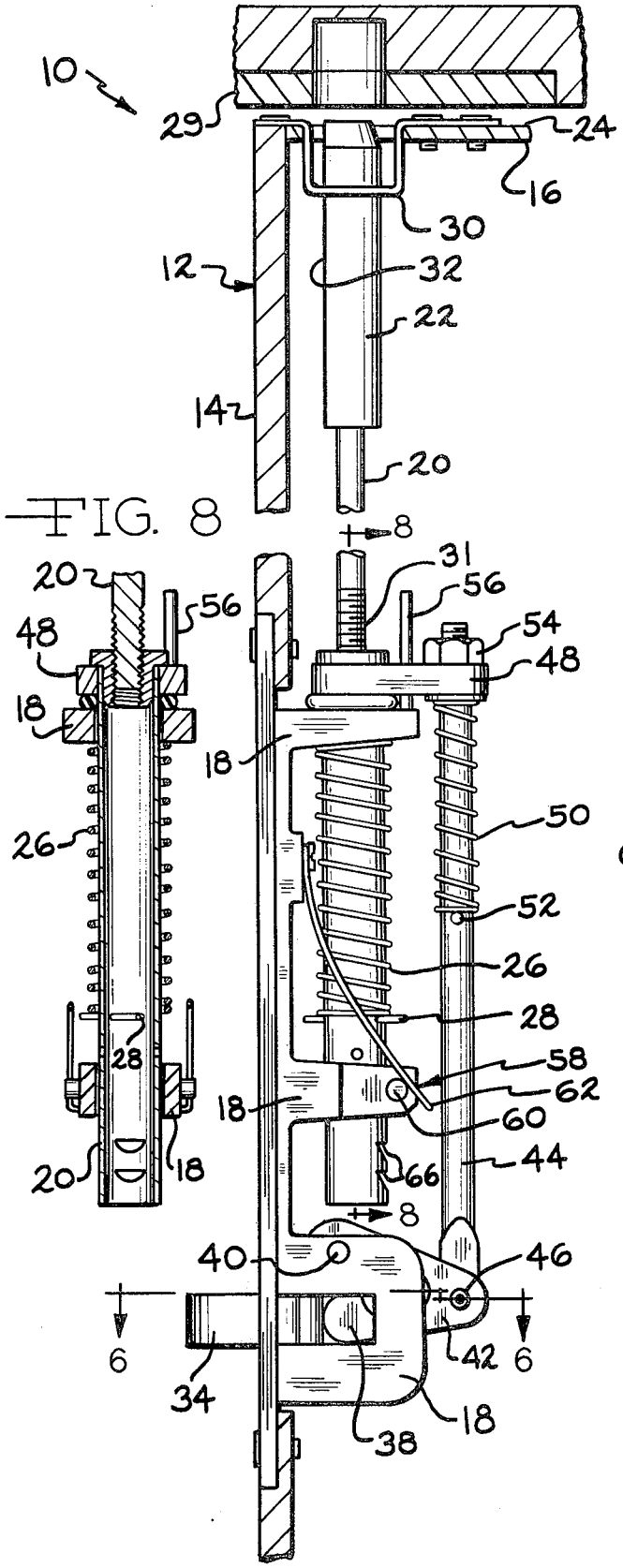
FIG. 8
FIG. 1
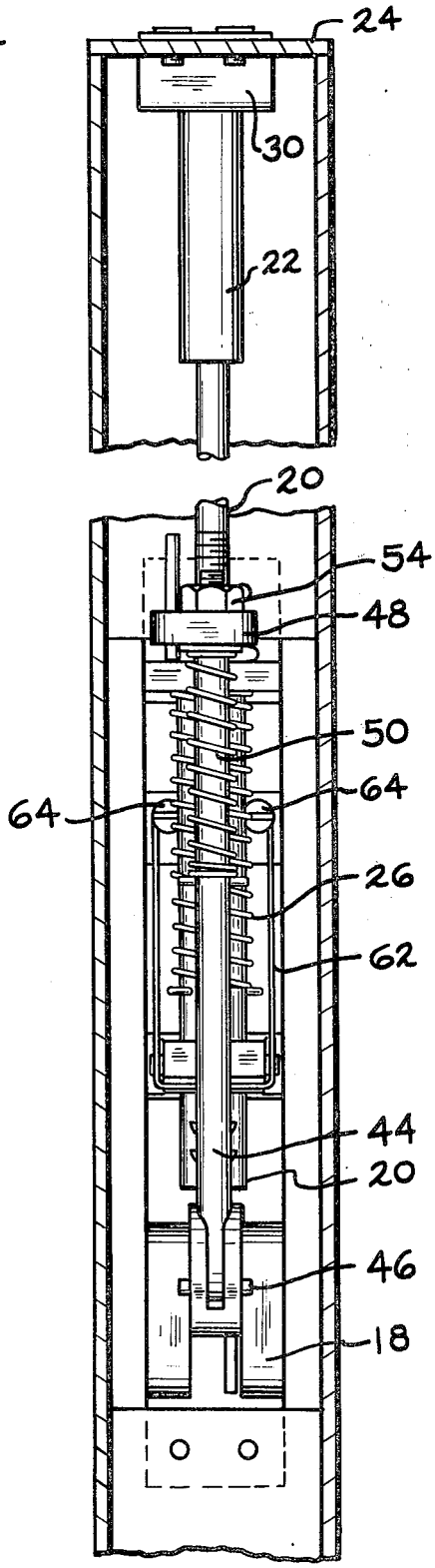
FIG. 2

FLUSH BOLT MECHANISMS

BACKGROUND OF THE INVENTION

The present invention relates to a flush bolt mechanism for latching the inactive one of a pair of swinging doors.

Flush bolt mechanisms are known in the prior art, as shown, for example, in U.S. Pat. Nos. 2,034,570 and 3,578,369. These references show devices that have served to meet, in part, the needs of industry, although they are not fully satisfactory to meet existing requirements. Not only is it necessary that the flush bolt mechanism function to bolt the closed inactive door when the other of a pair of swinging doors is closed, but it is also desirable that the flush bolt mechanism function in a most satisfactory manner so that (1) it has a long and trouble-free life; (2) it will prevent retraction of the bolt when the flush bolt mechanism is subjected to heat conditions which are likely to cause buckling of the doors; (3) it will allow retraction of the bolt when forces of a predetermined magnitude are applied to the inactive door but not when the flush bolt mechanism has been subjected to the foregoing heat conditions; (4) damage is prevented to its components, such as its latch bolt, its actuator cam or the like, where the doors may become damaged or warped during usage that prevents proper alignment of the latch bolt with the keeper; and/or (5) it requires a force applied to the active door when closing the latter of only a relatively small preselected magnitude to drive the latch bolt home into the keeper. These and other needs which will not be discussed here are not satisfactorily met by the prior art.

SUMMARY OF THE INVENTION

The present invention has overcome the inadequacies of the prior art and meets the needs of industry set forth above.

According to one form of the present invention a bolt mechanism is provided for use in conjunction with a pair of swinging doors, the bolt mechanism comprising a support member having a surface adapted to be mounted essentially flush with the free edge of the pair of swinging doors, a shaft support means extending from the support member on the side thereof opposite said surface, a first shaft slidably carried by the support means and including a latch bolt at one end thereof adapted to be extended beyond a horizontal edge of the door, a spring means normally biasing the first shaft to a retracted position, a cam pivotally carried by the support member on an axis parallel to the first shaft and extending beyond the surface thereof and adapted to be engaged by the other of the swinging doors, a cam follower engaged by the cam, said follower being pivotally carried by the support member on an axis parallel to the said surface and in a plane perpendicular to the first shaft and having a lever arm mounted for movement about the cam follower axis, a second shaft pivotally carried at one end by the distal end of the lever arm and carried at the other end by the first shaft so that linear movement can be imparted to the first shaft against the bias of the spring upon movement of the second shaft in response to pivoting of the cam when engaged by the other of the swinging doors.

The second shaft is carried by the first shaft by a slide connection, and an override spring means normally biases the second shaft to an extended position relative to the first shaft, the first-named spring means and the override spring means having spring characteristics so that the first-named spring means can be displaced axially by a lesser load than is required to displace the override spring means. By virtue of this arrangement, an axial force of a preselected magnitude can be applied axially against the latch bolt and in combination with the spring force of the first-named spring means will move the latch bolt to its retracted position against opposition of the override spring means. If desired, either the keeper or the latch bolt can then be provided with a beveled surface so that a force applied against the door from the inner side thereof will exert a component of force axially against the latch bolt resulting in it being moved to its retracted position when the force exerted on the door is of a sufficient magnitude.

The bolt mechanism also has a heat-responsive mechanism whereby when the bolt mechanism is subjected to a predetermined temperature for a time sufficient to melt an element of the heat-responsive mechanism, the bolt mechanism will then be locked in the extended position of the latch bolt to prevent the door from inadvertently opening because of buckling during a fire or other condition which exposes the doors to abnormally high temperatures.

Thus, it is an object of the present invention to provide an improved flush bolt mechanism which more readily meets the needs of industry than can be realized from the prior art devices.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a fragmentary vertical section taken through a door and door frame illustrating in elevation a flush bolt mechanism embodying the present invention;

FIG. 2 is a rear elevational view of the flush bolt mechanism illustrated in FIG. 1;

FIG. 8 is a fragmentary sectional view taken on the line 8—8 of FIG. 1;

DESCRIPTION OF THE PREFERRED EMBODIMENTS

Figure 3:
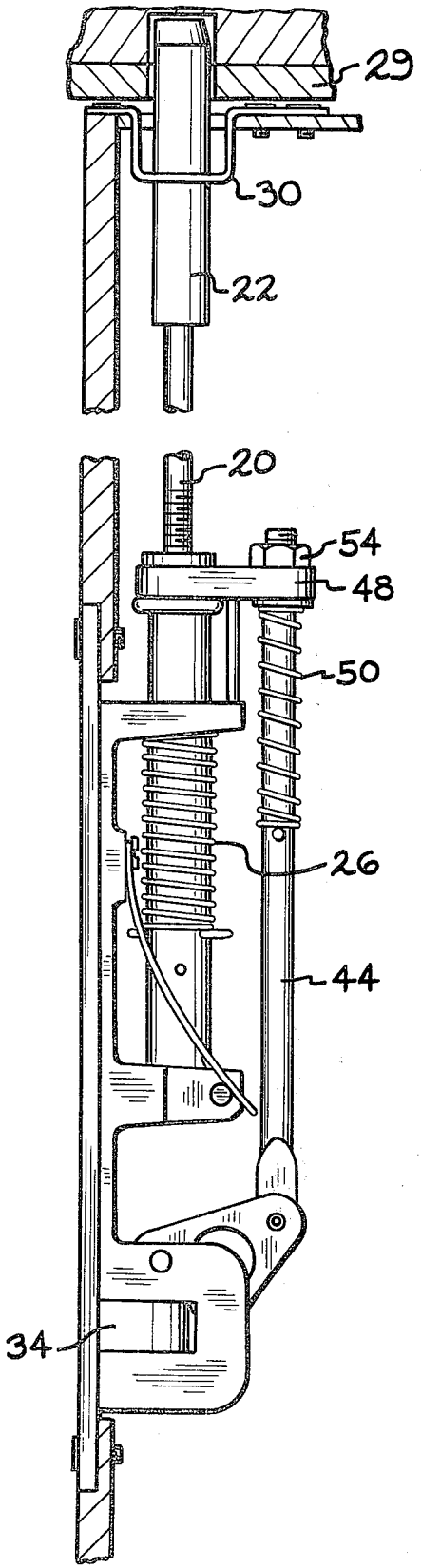
FIG. 3 is an elevational view similar to FIG. 1, but showing the flush bolt mechanism in its extended position.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The bolt mechanism 10 includes a support member 12 having a surface 14 adapted to be mounted essentially flush with the free edge of one of a pair of swinging doors 16. A shaft support means 18 extends from the support member on the side thereof opposite the surface 14, and a first shaft 20 is slidably carried by the support means 18 and includes a latch bolt 22 at one end thereof adapted to be extended beyond a horizontal edge 24 of the door 16. A spring means 26 normally biases the first shaft to the retracted position shown in FIG. 1. For this purpose, a spring retainer 28 is fixed to the first shaft 20 and the spring 26 is held in compression between the retainer 28 and the shaft support means 18. To permit adjustment of the latch bolt 22 so that when in its retracted position it will be substantially flush with the surface 24 and so that when extended it will extend properly into keeper 29, the first shaft is constructed in a two-piece assembly threadedly connected together as at 31 to allow the first shaft 20 to be extended or contracted when being installed so that it has the proper length. A guide bracket 30 is mounted on the upper end of the door 16 through which the latch bolt 22 passes and is guided therein. Normally, the front edge 32 of the latch bolt 22 has a flat surface which rides against a flat edge, not shown, in the bracket 30 so that after installation has been completed, the first shaft 20 cannot rotate in the bracket 30 so as to vary its length.

Figure 7:
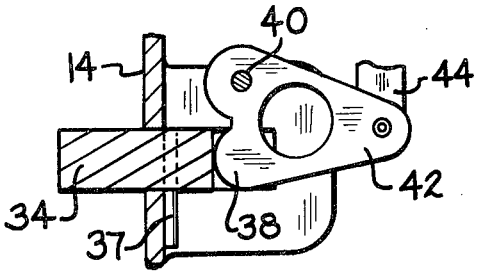
FIG. 7 is a fragmentary sectional view taken on the line 7—7 of FIG. 6.

A cam 34 is pivotally carried by the support means 18 on a pin 37, FIG. 7, which provides an axis parallel to the first shaft 20. The cam 34 extends beyond the surface 14 and is adapted to be engaged by the other of the swinging doors (not shown). A cam follower 38 is pivotally mounted on the pin 40 carried by the shaft support means 18, and it can be seen that this arrangement provides an axis that is parallel to the surface 14 and is in a plane perpendicular to the first shaft 20. The cam follower has a lever arm 42 that can be moved around the axis of the pin 40. A second shaft 44 is pivotally carried at one end by the pin 46 carried in the end of the lever arm 42, and the other end of the second shaft 44 is carried by the first shaft 20 by the arm 48 which is fixed at one end for travel with the first shaft 20 and provides a sliding fit at the other end for the second shaft 44. An override spring means 50, which is in the form of a compression spring held in a state of compression between the pin 52 and the arm 48, is provided for normally holding the second shaft 44 in fixed relation with respect to the first shaft 20. A nut 54 is threadedly connected to the upper end of the second shaft 44 to retain the override spring means 50 in place, and by virtue of the threaded connection between the nut 54 and the second shaft 44, the second shaft 44 can be displaced axially a small amount relative to the first shaft 20 so as to pivot the lever arm 42 about its axis 40, and thereby to assure that when initial installation is made, the cam follower 38 will be in engagement with the cam 34.

The shaft support means 18 also carries a pin 56 which passes through a hole (not shown) in the arm 48 to assist in maintaining the arm 48 in proper orientation with respect to the support means 18.

Figure 5:
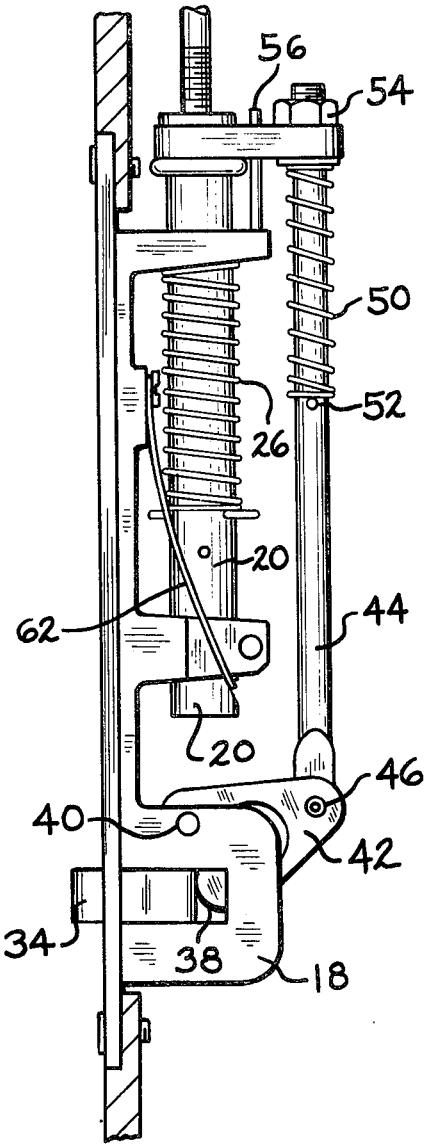
FIG. 5 is a view similar to FIG. 3, but showing the heat-responsive mechanism in a position to lock the latch bolt in an extended position.

To prevent the door 16 from inadvertently opening if cam 34 should pivot due to a buckling condition of the doors which may be caused by fire or the like, a heat-responsive mechanism 58 is provided which is mounted on the support member 18 and is responsive to ambient temperature of a selected magnitude to secure the first shaft 20 against movement from its extended to its retracted position. The heat-responsive mechanism 58 includes a pin 60 made of any of the well known fusible metals or alloys such as bismuth, lead and tin or of these three metals and cadmium or mercury which can be combined to fuse or melt at a predetermined temperature When in its solid state, the pin 60 functions to hold the U-shaped resilient element 62 in a bowed, stressed condition, such as can be seen in FIG. 1, and when the pin has melted or fused, the resilient element 62 will be released to move to a position, such as is shown in FIG. 5, where it is in engagement with the shaft 20 to retain the latter in a fixed position. For mounting purposes, the upper ends of the resilient element 62 are secured by the screws 64 to the support means 18. The first shaft 20 has a plurality of notches or axially spaced shoulders 66 which are engaged by the lower end of the U-shaped resilient element 62 when the latter is released to hold the first shaft 20 in its extended position, which can be seen in FIG. 5.

When selecting the springs 50 and 26, suitable spring characteristics are required so that the forces required to move the shaft 20 to its retracted position are less than the forces of the spring 50 which serve to move the first shaft 20 to its extended position, as shown in FIG. 3, in response to the pivotal movement of the cam 34. Thus, under normal circumstances the first shaft 20 and the second shaft 44 will move upward and downward as a unit in response to pivotal movement of the cam 34 overcoming the spring forces of the spring 26 whenever the cam 34 is pivoted to the position shown in FIG. 3.

Figure 4:
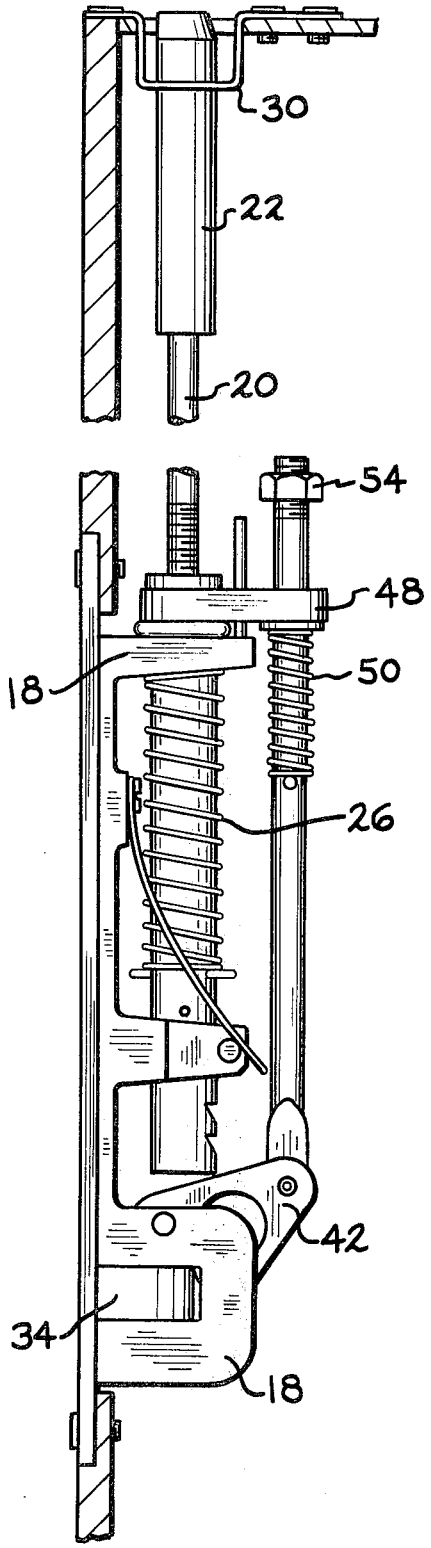
FIG. 4 is an elevational view similar to FIG. 3, but showing the latch bolt moved to its retracted position against the spring forces of the override spring means.
Figure 6:
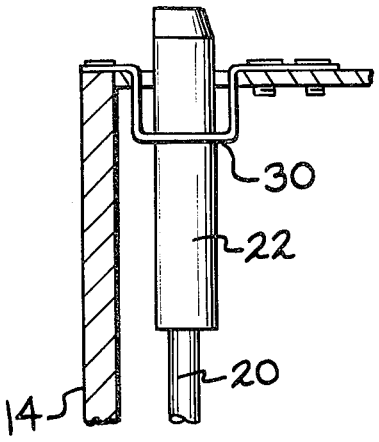
FIG. 6 is a fragmentary sectional view taken on the line 6—6 of FIG. 1.
Figure 6:
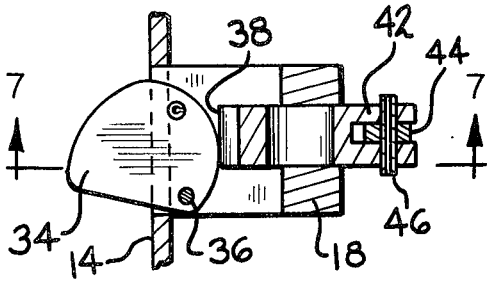

However, when forces of the preselected magnitude are exerted axially against the latch bolt 22, the spring 50 will yield, as shown in FIG. 4, to permit the latch bolt 22 to be moved to the position shown in FIG. 4. It will be recognized that this action can not occur when the heat-responsive mechanism 58 has been actuated and the U-shaped resilient element 62 is retainingly engaging the first shaft 20.

Figure 9:
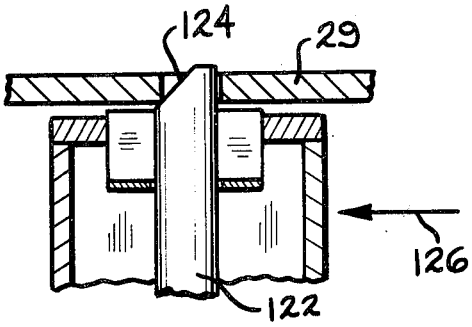
FIG. 9 is a fragmentary sectional view of a modified form of the flush bolt mechanism wherein the latch bolt has a beveled terminal end to allow the latch bolt to be retracted in response to a preselected force exerted on the inner side of the door.

In some instances it may be desired that a force of a preselected magnitude acting against the door 16 to open it be sufficient to overcome the locking action of the latch bolt 22, and for this purpose a modified latch bolt 122, as shown in FIG. 9, may be used to provide a beveled terminal end 124 which is shaped so that when a force is applied at 126 to the door, the reactive component of force acting upon the latch bolt 122 will be sufficient to compress the spring 50 to the position shown in FIG. 4, thereby permitting the door to be moved to an open position.

Figure 10:
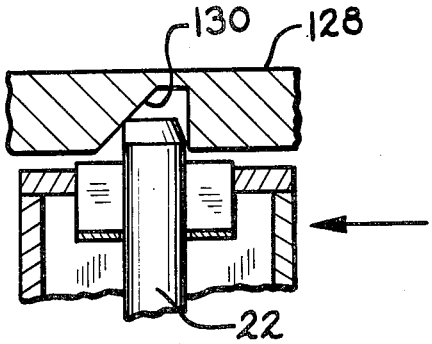
FIG. 10 is another embodiment of the flush bolt mechanism wherein the keeper has a beveled surface of predetermined magnitude for exerting an axial force against the keeper when a force of a predetermined magnitude is applied against the inner surface of the door.

Another modified form of this arrangement can be seen in FIG. 10 where the keeper 128 has a beveled surface 130 which serves to apply the same reactive vertical component of force against the latch bolt 22.

It is claimed:

1. For use in conjunction with a pair of swinging doors, a bolt mechanism comprising a support member having a surface adapted to be mounted essentially flush with the free edge of one of the pair of swinging doors, shaft support means extending from said support member on the side thereof opposite said surface, a first shaft slidably carried adjacent to said surface by said support means and including a latch bolt at one end thereof adapted to be extended beyond a horizontal edge of the door, spring means normally biasing said first shaft to a retracted position, a cam pivotally carried by said support member on an axis parallel to said first shaft and extending beyond the surface thereof and adapted to be engaged by the other of the swinging doors, a cam follower engaged by said cam, said cam follower being pivotally carried by said support member on an axis parallel to said surface and in a plane perpendicular to said first shaft and having a lever arm extending inward beyond said first shaft for movement about the cam follower axis, a second shaft parallel to said first shaft and pivotally carried at one end by the inward distal end of said lever arm and carried at the other end by a said first shaft so that linear movement can be imparted to said first shaft against the bias of said spring means upon generally axial movement of said second shaft in response to pivoting of said cam when engaged by the other of the swinging doors, said second shaft being carried in parallel relationship by said first shaft by a slide connection, and an override spring means normally biasing said second shaft to an extended position relative to said first shaft, the first-named spring means and said over-ride spring means having spring characteristics so that said first-named spring means can be displaced axially by a lesser load than is required to displace said override spring means.

2. The bolt mechanism that is defined in claim 1, wherein said bolt mechanism includes a keeper for mounting in a door frame and said latch bolt has a beveled edge at its terminal end for engagement with said keeper, said beveled edge being inclined an amount so that a force of a selected magnitude exerted against the door to open it will cause an axial component of force to be exerted against said latch bolt to overcome the spring forces of said override spring means and thereby to move said first shaft to its retracted position.

3. The bolt mechanism that is defined in claim 1, wherein said bolt mechanism includes a keeper for mounting in a door frame and said latch bolt has a terminal end for engagement with said keeper, said keeper having a beveled edge against which said terminal end can engage, said beveled edge being inclined an amount so that a force of a selected magnitude exerted against the door to open it will cause an axial component of force to be exerted against said latch bolt to overcome the spring forces of said override spring means and thereby to move said first shaft to its retracted position.

4. The bolt mechanism that is defined in claim 1, wherein said second shaft is axially adjustable relative to the location where it is carried by said first shaft so that the position of said lever arm can be varied to assure contact at all times of the cam follower with said cam.

5. The bolt mechanism that is defined in claim 1, wherein said first shaft is axially extensible and contractible for adjusting the position of the latch bolt relative to said horizontal edge of the door.

6. The bolt mechanism that is defined in claim 1, wherein a heat-responsive mechanism is mounted on said support member and is responsive to ambient temperature of a selected magnitude to operate to retain said first shaft against movement toward a retracted position.

7. The bolt mechanism that is defined in claim 6, wherein said heat-responsive mechanism includes a fusible metal spring retainer and a retention spring normally biased by said spring retainer away from operative engagement of said first shaft, said heat-responsive mechanism being responsive to ambient temperature so that said spring retainer will melt at said temperature to release said retention spring and to allow it to make operative engagement of said first shaft to retain the latter against movement toward its retracted position.

8. The bolt mechanism that is defined in claim 7, wherein said retention spring is a U-shaped resilient element which straddles said first shaft, the upper ends of the U-shaped resilient element being secured to said support member on one side of said first shaft and the lower end of said U-shaped resilient element being biased away from said first shaft by said spring retainer on the other side of said first shaft, said lower end being movable into operable engagement with said first shaft when said resilient element is released by said spring retainer.

9. The bolt mechanism that is defined in claim 8, wherein said first shaft has a plurality of axially spaced shoulders for operable engagement by the lower end of said U-shaped resilient element.

* * * * *